US005529564A

United States Patent [19]

Hediger

[11] Patent Number: 5,529,564

[45] Date of Patent: Jun. 25, 1996

[54] APPARATUS FOR DEPOSITING, GUIDING AND PRESSING MATERIAL WEB PARTS TO BE STACKED

[75] Inventor: Hanspeter Hediger, Sempach, Switzerland

[73] Assignee: Jos. Hunkeler, Ltd., Wikon, Switzerland

[21] Appl. No.: 163,187

[22] Filed: Dec. 6, 1993

[30] Foreign Application Priority Data

Dec. 4, 1992 [CH] Switzerland ..... 03725/92

[51] Int. Cl.[6] ..... B65H 45/20; B65H 35/10

[52] U.S. Cl. ..... 493/413; 493/357; 493/411; 493/414; 225/5; 225/100

[58] Field of Search ..... 493/357, 356, 493/410, 412, 414, 413, 415, 450, 353, 324, 411, 434, 435; 225/5, 100, 101

[56] References Cited

U.S. PATENT DOCUMENTS

| | | | |
|---|---|---|---|
| 3,278,178 | 11/1964 | Eckl | 493/410 |
| 3,888,399 | 6/1975 | Hanson et al. | 225/100 |
| 4,045,012 | 8/1977 | Jakob | 493/415 |
| 4,261,497 | 4/1981 | Roetter et al. | 225/100 |
| 4,388,072 | 6/1983 | Mueller et al. | 493/410 |
| 4,507,109 | 3/1985 | Meschi | 493/356 |
| 4,576,670 | 3/1986 | Felix | 493/413 |
| 4,618,085 | 10/1986 | Kimura et al. | 225/100 |
| 4,824,091 | 4/1989 | Knight | 271/178 |
| 4,846,454 | 7/1989 | Parkander | 493/412 |
| 5,042,789 | 8/1991 | Hediger | 493/413 |
| 5,064,179 | 11/1991 | Martin | 493/357 |
| 5,104,366 | 4/1992 | Bunch | 493/414 |
| 5,201,700 | 4/1993 | Meschi | 493/412 |

FOREIGN PATENT DOCUMENTS

| | | | |
|---|---|---|---|
| 2519420 | of 0000 | Germany . | |
| 2247517 | of 0000 | Germany | B65H 45/18 |
| 2028771 | 3/1980 | United Kingdom | B65H 35/10 |
| 3131400 | 6/1984 | United Kingdom | B65H 35/10 |
| WO92/02443 | 2/1992 | WIPO | B65H 45/20 |

*Primary Examiner*—Jack W. Lavinder
*Assistant Examiner*—Christopher W. Day
*Attorney, Agent, or Firm*—Fish & Richardson

[57] ABSTRACT

Apparatus to separate web parts from a continuous web and feed them in zig-zag fashion onto a stack. Arranged at the sides of stack are holding-down elements designed in the manner of a paddle. These holding-down elements are moved along an elliptical path in such a way that they execute a movement directed downwards and laterally outwards towards the sides of the stack. In this movement, they come into contact in the region of the folding locations with the material web parts, be they individual sheets or longer parts to be folded in a zigzag form and press the engaged region of the material web parts downwards and outwards towards the sides of the stack. In this way, a satisfactory fold is formed at the respectively correct location, even in the case of material web sections which have neither been prefolded nor provided with lines of weakness beforehand. Also, a process for forming web parts, feeding them to a stack, and pressing them down as described.

10 Claims, 9 Drawing Sheets

100

APPARATUS FOR DEPOSITING, GUIDING AND PRESSING MATERIAL WEB PARTS TO BE STACKED

The present invention relates to a process and an apparatus for depositing and guiding a material web section fed in zigzag form from above to a stack.

It is known from U.S. Pat. No. 4,507,109, for guiding and depositing material web sections to be folded in zigzag form along predetermined folding lines, to provide at the sides of the stack holding-down elements which have pins fastened on a shaft and protruding from the latter. By means of these pins, the material web is pressed in the region of the predetermined folding lines against the upper side of the stack.

An object of the present invention is providing a process and an apparatus for satisfactory folding of material web sections accurately at the desired locations.

It is a further object of this invention to provide a process and apparatus that also separates a continuous web of paper or other material into sections as it is folded and stacked.

The objects are achieved according to the process and apparatus of this invention so that it is possible to fold the material web sections with great accuracy in each case at the desired locations satisfactorily and without creasing, even in the case of material web sections which have neither been prefolded nor provided with lines of weakness establishing the folding locations beforehand.

Preferred embodiments of the process according to the invention and of the apparatus according to the invention include elliptically traveling folding and holding-down elements that press fed web sections downwardly and outwardly to form accurate folds. Especially preferred embodiments include folding and holding-down elements that remain essentially parallel during travel, and driving arrangements therefor. Some preferred embodiments include web-sectioning means for tearing cross-perforated web without jerking.

Illustrative embodiments of the process according to the invention and of the apparatus according to the invention are described in detail below with reference to the drawings.

DETAILED DESCRIPTION

The process and apparatus of this invention will be described with reference to particularly preferred embodiments shown in the Figures, which are illustrative and are not intended to limit the invention defined in the claims. System 100 represented in FIG. 1 comprises a height-adjustable separating and folding device 101, which is denoted in its upper position by solid-line box 101*a* and in its lower position by broken-line box 101*b*, and which serves for severing a material web 102 into web parts 103' which may comprise in some instances individual sheets, and for folding and depositing the detached web parts 103' whether folded parts or individual sheets, onto a stack 105. In the illustrative embodiment shown in FIG. 1, the stack 105 is deposited onto a delivery transport belt 106, which is not adjustable in height and in place of which there may also be provided a different device, such as for example a lifting table or a transport carriage. The separating and folding device 101 is adjustable in height as shown by lower position 101*b* and upper position 101*a*, in order to permit an adaptation to the height of the stack 105.

During the removal of a finished stack 105, the material web 102 is stopped briefly and the delivery transport belt 106 is set in motion.

Figure 2:
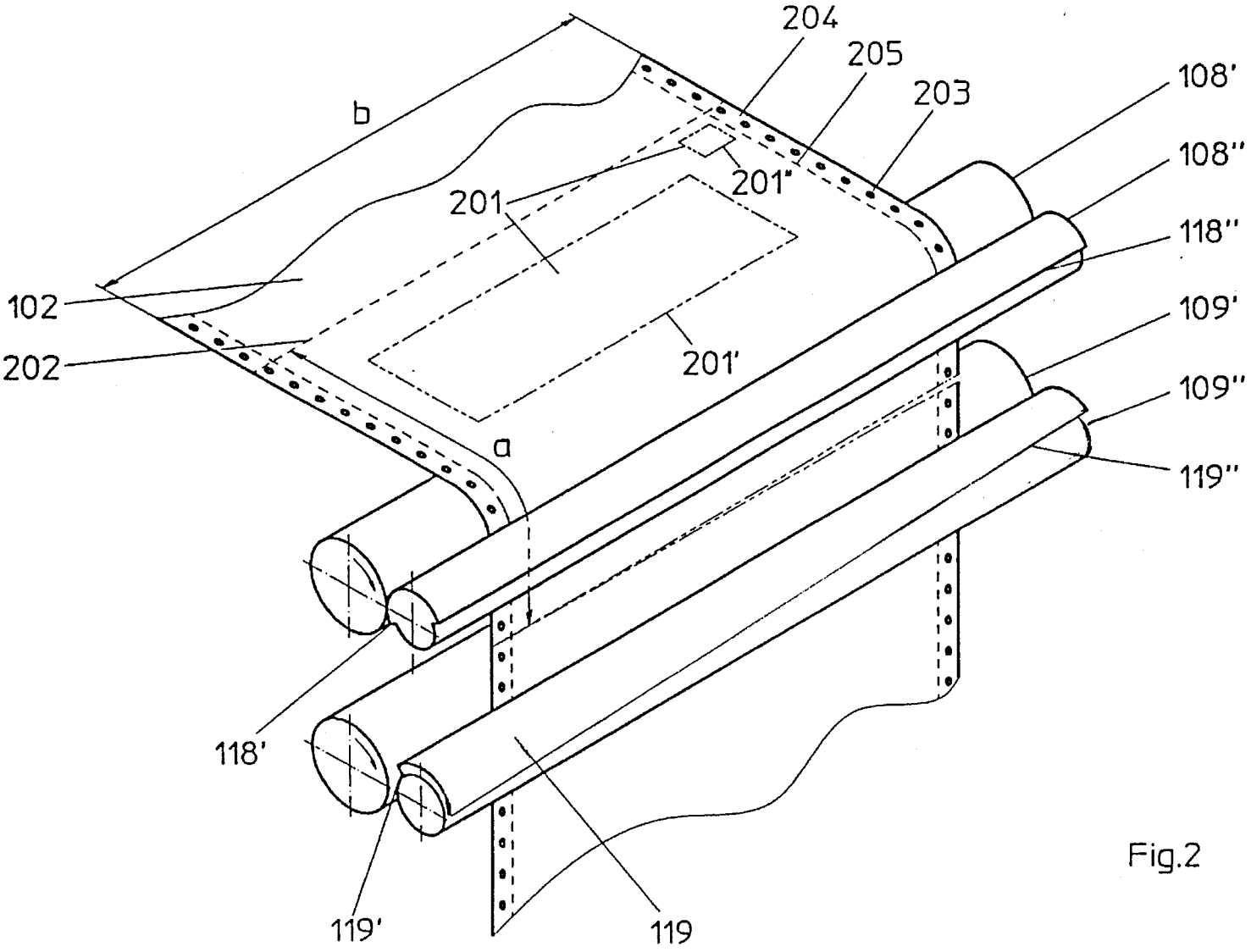
FIG. 2 is a perspective view of the portion of the apparatus of FIG. 1 for severing the material web during the severing operation.

The material web 102, commonly but not necessarily a paper web, is represented in greater detail in FIG. 2. Web 102 is prefabricated, which is intended to mean that it may contain printing at 201, has lines of weakness or predetermined separating or severing lines 202 (perforation lines or cross perforations) and includes edge transport perforations 203 for feeding.

Printed portion 201 may comprise for example, on the one hand, particulars 201' for the recipient of the corresponding web part or individual sheet and, on the other hand, printed-on, optically or magnetically readable markings 201", for controlling processing steps, to which the corresponding web part 102 is to be subjected.

The lines of weakness or predetermined separating lines 202 may, for example, be preperforated and run at regular longitudinal intervals "a", which correspond to the one side dimension of the stack 105, over the entire width "b" of the material web 102. The smallest part which can be detached from the material web 102, which part is referred to from now on as a single sheet, consequently has a width which corresponds to the width b of the material web 102, while its height corresponds to the dimension a. Larger detachable web parts of the web 102 have lengths which amount to integral multiples of the dimension a and in the finished stack 105 are respectively folded along the lines of weakness 202. Where larger web parts are intended weakening lines 202 may be omitted except for severing locations, because the process and apparatus of this invention permits accurate folding without creasing in the absence of weakening lines.

The transport perforations 203 run on both sides along edge strips 204 of the material web 102 and serve for its transport. For detaching these strips 204 from the end product, generally further, edge-parallel preperforations 205 are provided.

Figure 1:
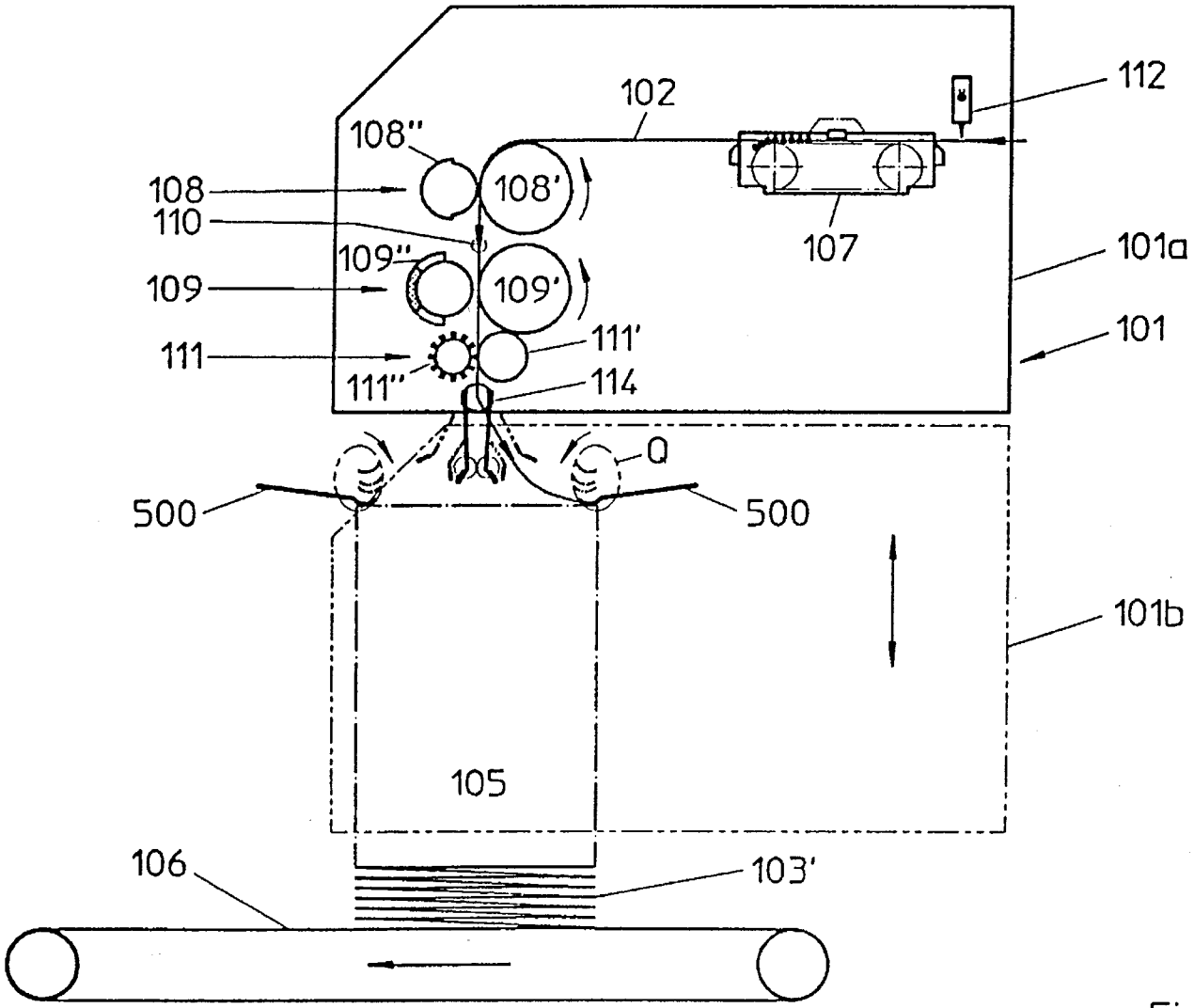
FIG. 1 is a schematic side view of apparatus of this invention for severing a continuously fed material web into web parts and also for subsequently depositing and pressing the same, folded and oriented as desired, onto a stack.

In the embodiment shown in FIG. 1, that part of the device 101 which serves for severing the material web 102 has a transport device 107 for the material web 102. Transport device 107 may be of a type well known in the art, for example, a pair of tractors with pin-like conveying elements, which engage in the transport perforations 203 on the longitudinal edges of the material web 102. Arranged downstream of the transport device 107 is a first pair of rollers 108, which comprises a transport roller 108' and a clamping roller 108" described later in more detail Arranged downstream of this first pair of rollers 108 is a second pair of rollers 109, which is formed by a further transport roller 109' and a severing roller, also referred to in the following as a tearing roller 109" and described in more detail further below. Located between the pairs of rollers 108 and 109 the separating zone 110, where the individual web parts 103' (FIG. 3*c*) are detached from the material web 102 and which may, as mentioned earlier, have different lengths. Arranged downstream of the second pair of rollers 109 is a third pair of rollers 111, for example comprising a roller 111' with a smooth surface and a brush roller 111". This third pair of rollers 111 serves as a transporting means for the already detached web parts 103'.

Figure 3A:
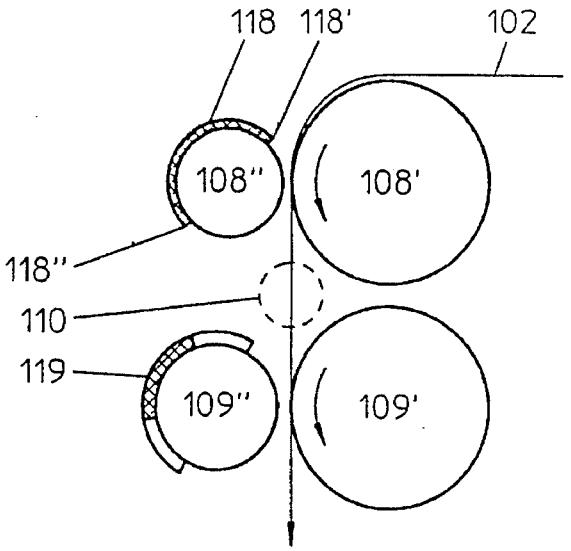
FIGS. 3*a*, 3*b* and 3*c* show the 2 pairs of rollers represented in FIG. 2 in various stages of the severing operation in a simplified representation in a section perpendicular to their axes.
Figure 3B:
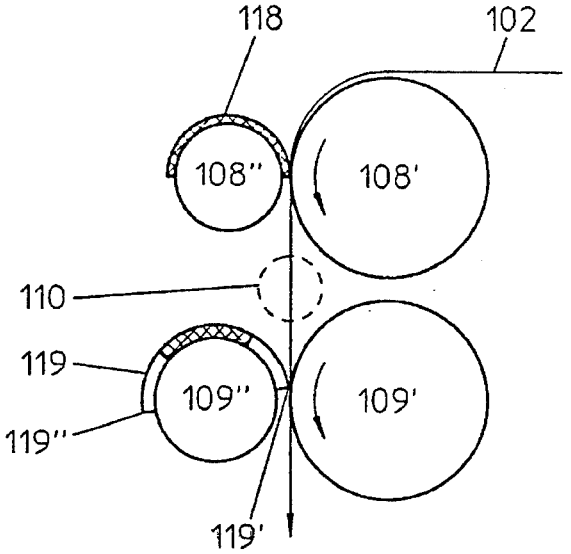
Figure 3C:
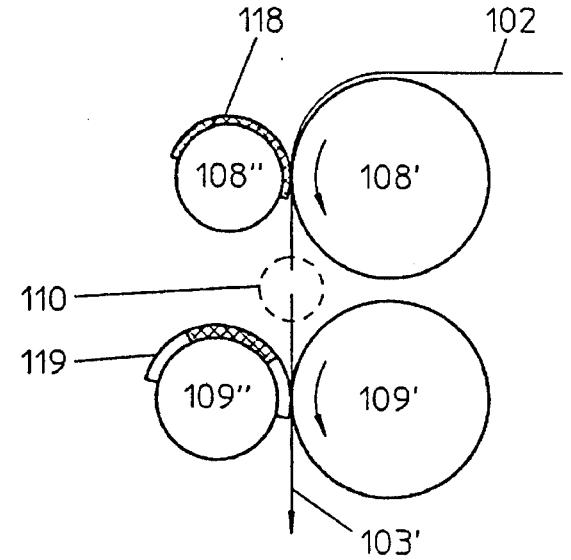

Also shown in FIG. 1 is a sensing member, preferably a reading or feeling member 112, which senses the markings 201". This reading or feeling member 112, per se well known in the art, senses control markings that include indications of where the web is to be separated into individual sheets or longer web parts. Sensor 112 is connected via a control line to a coupling device (not shown) of conventional design for the clamping roller 108" and the tearing roller 109". The clamping roller 108" and the tearing roller 109" can be driven, that is, rotated, at staggered time intervals by means of this coupling device and thus turn between a rest position, which is represented in FIG. 3*a* and an active position, which is represented in FIGS. 3*b* and 3*c*.

Control and drive means for the various elements of system 100 are well known in the art and will not be described here in detail. For example, device 107 may have a variable-speed drive, which may be slaved, if desired, in a known manner to upstream processing apparatus such as printing or perforating apparatus. Similarly, the various elements of system 100 may be slaved to device 107 for proper speed synchronization. Severing is accomplished, as stated above, by rollers 108 and 109, which intermittently clamp and tear web 102 as desired. Control of the coupling means for engaging the clamping and tearing rollers to reading or feeling member 112 may also be by customary means well known in the art, including electronic digital control means, which will be understood by workers in the art. A stepping motor (not shown) may serve, for example, for driving the pairs of rollers 108, 109 and 111. The transport rollers 108' and 111' run at a circumferential speed which corresponds to the normal feed rate of the material web 102, while the circumferential speed of the transport roller 109' is somewhat higher than the feed rate. The clamping roller 108" and the tearing roller 109" are normally stationary and can be connected by the said coupling device, designed as a one-stop clutch, to the drive and be turned at the same circumferential speed as the associated transport rollers 108' and 109'.

The pairs of rollers 108 and 109 are described below with reference to FIGS. 2, 3*a*, 3*b* and 3*c*, the direction of rotation of the transport rollers being respectively indicated in the figures by an arrow.

Clamping roller 108" has a radially projecting raised section, here covering 118 of a suitable material, which extends over part of its circumference and comes to bear against the material web 102. Suitable covering materials will be apparent to workers in the art. The covering 118 extends at least over that part of the roller width which corresponds to the maximum width b of the material web 102. The covering 118 is bounded in the circumferential direction by two edges 118' and 118" of which at least the leading edge 118' extends parallel to the axes of the pair of rollers 108.

Like the clamping roller 108" the tearing roller 109" likewise has a radially projecting raised section, here covering 119, which extends over part of its circumference and—like the covering 118—extends over at least that part of the roller width which corresponds to the maximum width b of the material web. A leading outer edge 119' which bounds the covering 119, runs helically The trailing edge 119" bounding the covering 119, may run as desired, for example axially parallel: it is, however, advantageous to make it likewise helical, since this allows a reversal (removal and refitting) of the tearing roller 109 if the covering 119 is worn in the region of its leading edge 119'.

As already mentioned, located between the pairs of rollers 108 and 109 is the actual tearing or severing zone 110.

The operating principle of the components described thus far is as follows:

When regions of the material web 102 not to be separated from one another are running through, the clamping roller 108" and the tearing roller 109" are located in their rest position according to FIG. 3*a*, so that a run-through gap for the material web 102 is formed. The material web 102 touches only the transport rollers 108' and 109'. When a part of the material web 102 with a marking 201" indicating a severing to be carried out, to make individual sheets or longer web parts 103, passes the reading or feeling member 112, this causes the clamping roller 108" and the tearing roller 109" to be coupled via the coupling device to the drive and thus to be set in rotation with the respectively correct time delay and turned into their active positions according to FIGS. 3*b* and 3*c*. In this process, according to FIG. 3*b*, firstly the rotation of the clamping roller 108" and consequently the clamping firmly of the material web 102 over its entire width b between the transport roller 108' and the surface of the covering 118 of the clamping roller 108" takes place along a common surface line of the transport roller 108' and the surface of the covering 118. The line of weakness 202, along which a severing of the material web 102 is intended, is located in the separation zone 110. Then, the tearing roller 109" is also turned into its active position. Since, on account of its helical progression, the leading edge 119' bounding the covering 119, comes to bear against the material web 102 firstly at the righthand longitudinal edge (FIG. 2) of the material web 102 and subsequently continuously over its width, the tearing or separating force exerted by the pair of rollers 109 does not act simultaneously over the entire width b of the material web 102, instead its point of application shifts diagonally according to FIG. 2 from the right-hand edge of the material web 102 progressively to its left-hand edge, while the then already partially detached web part 103' of the original material web 102 runs on. During the further rotation of the pair of rollers 109, the severing thus takes place progressively over the entire width b and the leading part 103' be it a single sheet or longer web part, of the material web 102 is separated from the trailing part, as can be seen in FIG. 3*c*. This allows the tearing operation to be carried out smoothly and not jerkily, without it being necessary for the material web to be stopped for this. The clamping roller 108" and the tearing roller 109" are then turned back or turned forward into their rest positions.

That part of the device 101 which serves for stacking and pressing the original material web 102, now severed into web parts 103' is described below, with particular reference to FIGS. 4 and 5.

As FIG. 1 shows, the third pair of rollers 111 is followed, seen in the feeding direction, by that part of the device 101 which serves both for depositing the web parts 103' detached from the material web 102 onto the stack 105 and for holding down the same on the stack 105.

For depositing the detached web parts 103' to form a stack 105, there is provided as guide means for the web parts 103', a folding rocker 114, which is of a type of design known per se and is described in more detail further below. In addition, means are provided which ensure the correct and accurate bearing of the leading and trailing edges of the web parts 103' against vertical stops 419' or 419" defining the opposing sides of and bounding a stacking space. These means may be a brush device moving back and forth between the stops or, as in the present illustrative embodiment, a compressed-air system for discharging blasting air, which is discharged at suitable intervals and in suitable directions, as indicated by the arrow D in FIGS. 4*a, b* and *d.*

For forming the folding lines, if the web parts are longer than individual sheets, and for depositing the web sections, whether they are multiple or individual sheets, a folding and holding down device is used, which has at least one folding and holding-down element 500, which may be referred to as a pressing element, also referred to hereafter as a paddle because of its shape. Each paddle extends from outside to a region above the stack near its side. In the present illustrative embodiment there are two folding and holding-down, or pressing, elements 500, which come into contact with the respectively upwardly pointing face of the uppermost web part 103' of the stack 105 with an active face 502, which is convex with respect to the stack 105. The paddles 500 are driven by a supporting and drive device, which is described later.

Figure 4A:
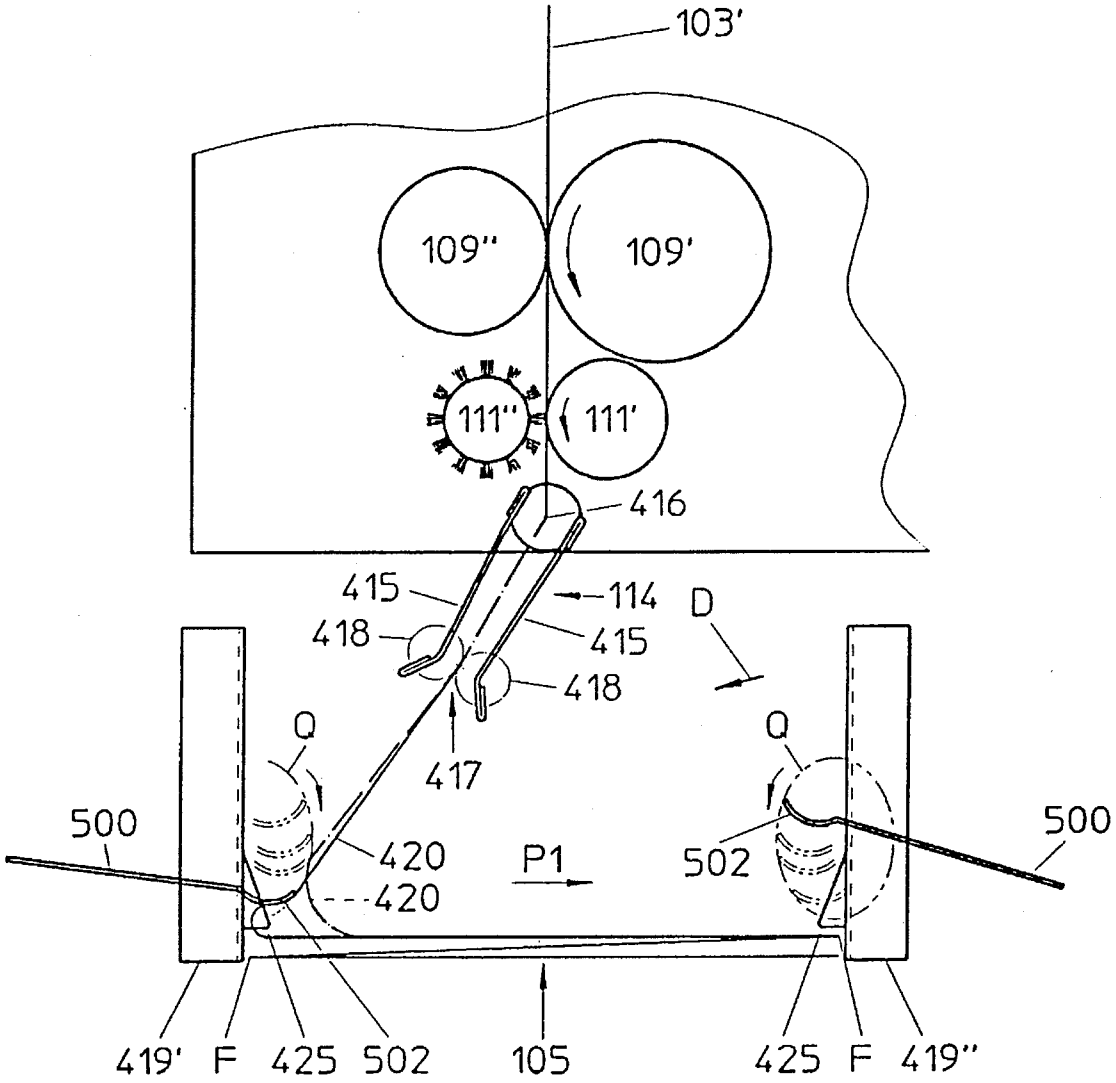
FIGS. 4*a*, 4*b*, 4*c* and 4*d* show the folding and stacking portion of the apparatus of FIG. 1 in various positions during the folding and stacking operation, in a simplified elevation from the front.

The folding rocker 114, represented in FIGS. 4*a,* 4*b,* 4*c* and 4*d,* has two approximately parallel arms 415, between which the web parts 103' run. The folding rocker 114 swings back and forth between a left-hand end position, represented in FIGS. 4*a* and 4*b,* and a right-hand end position, represented in FIG. 4*d,* its axis of swing 416 running parallel to the axes of the pairs of rollers 108, 109 and 111. The inlet side of the folding rocker 114 is aligned essentially at all times with the leading edge of the web part 103' fed to it through the nip of the pair of rollers 111. On the outlet side 417 of the folding rocker 114 there may be provided optionally a further pair of transport rollers 418. In its end positions, the folding rocker 114 is directed at the left-hand stop 419', in FIGS. 4*a*–4*d,* and at the righthand stop 419", in FIGS. 4*a*–4*d,* respectively. The leading and trailing edges of the detached web parts 103' come to bear against these stops 419' and 419" and the mutual spacing of the stops 419' and 419" corresponds to the spacing a of the lines of weakness 202 (or the spacing a where lines 202 would appear if provided for every sheet) in the original material web 102 and consequently to the height of the individual sheets or of the individual sections of the web part 103' folded in a zigzag form, detached from the said material web and the width of the stack 105 from side to side. The movement of the folding rocker 114 may be controlled in such a way that the leading edge of an individual sheet or longer web part 103' comes to bear against the right-hand or left-hand stop, depending on which surface of the web part 103' is to come to lie upwards and downwards in the stack 105. To simplify the further processing of the web parts 103' folded in a zigzag manner, or of the individual sheets 103' it is generally required that the web parts 103' are deposited such that their leading edges are congruent in the stack produced, and that in the case of each individual sheet or in the case of the first sections of each web part it is always the same surface of the material web which is directed downwards. It is, furthermore, possible by means known in the art to control the movement of the folding rocker 114 variably or to displace the stops 419' and 419" or to use another known way to produce stacks in which the edges of the stacked material are arranged not flush but offset with respect to one another.

Figure 4B:
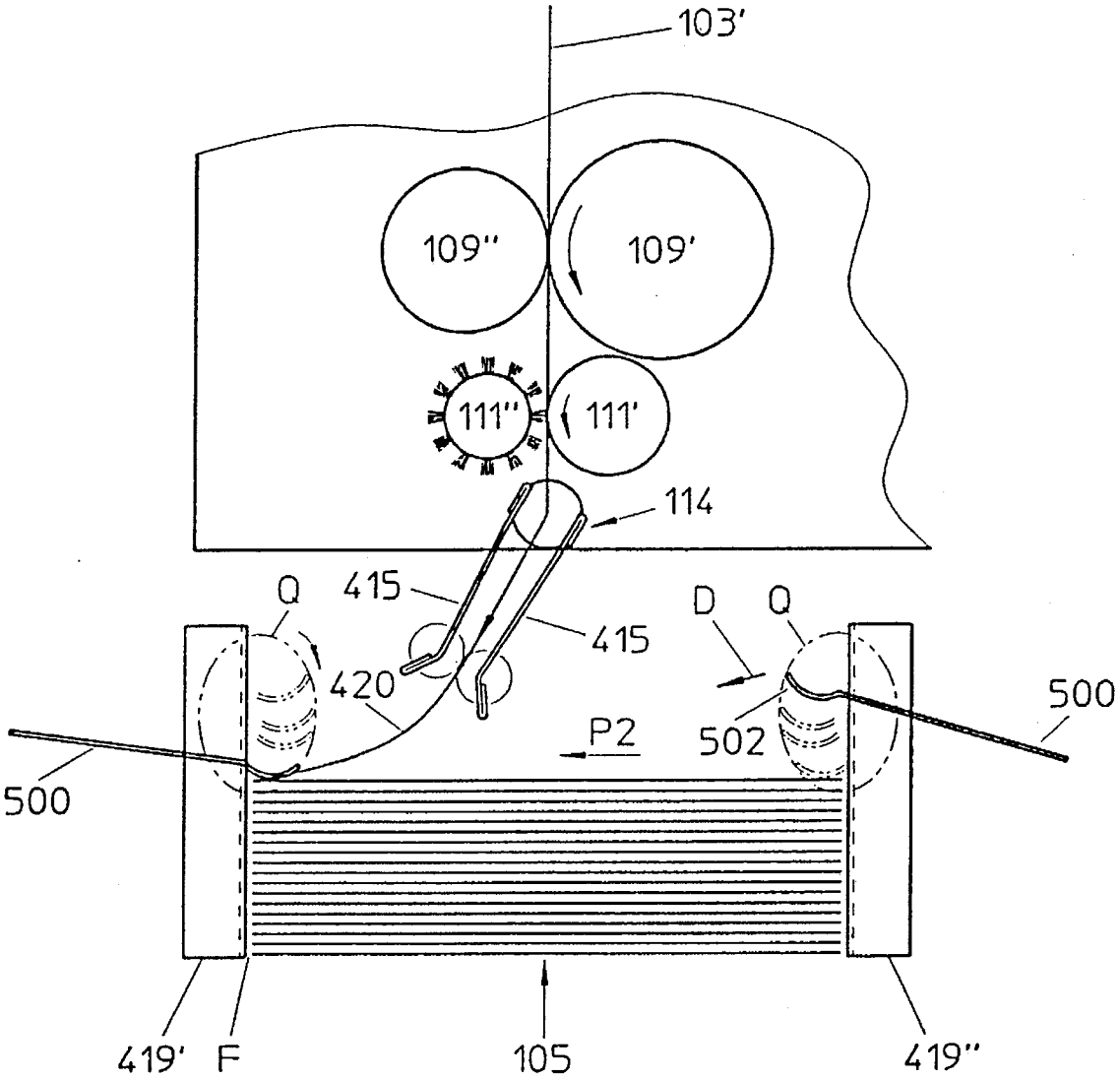
Figure 4C:
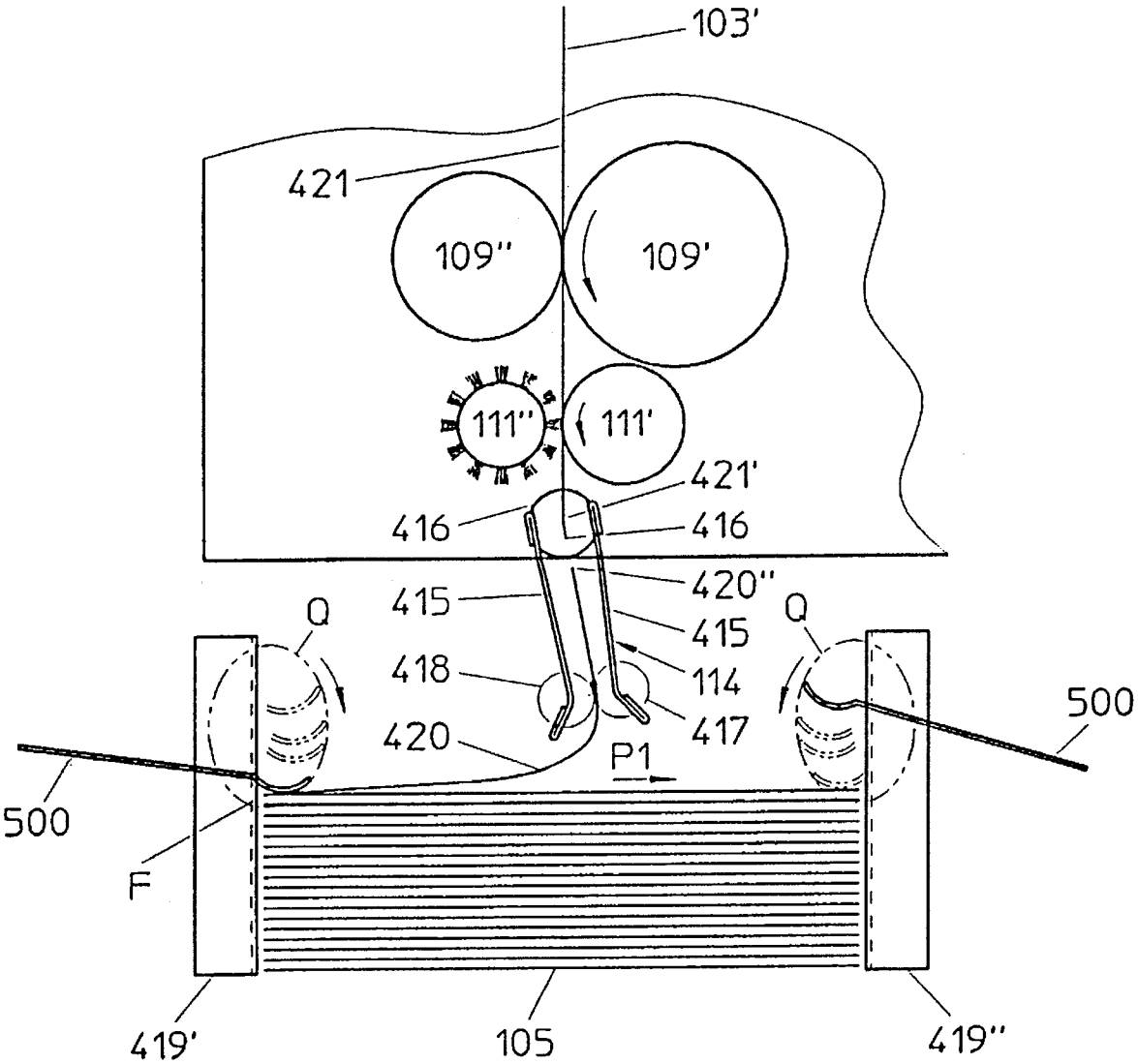
Figure 4D:
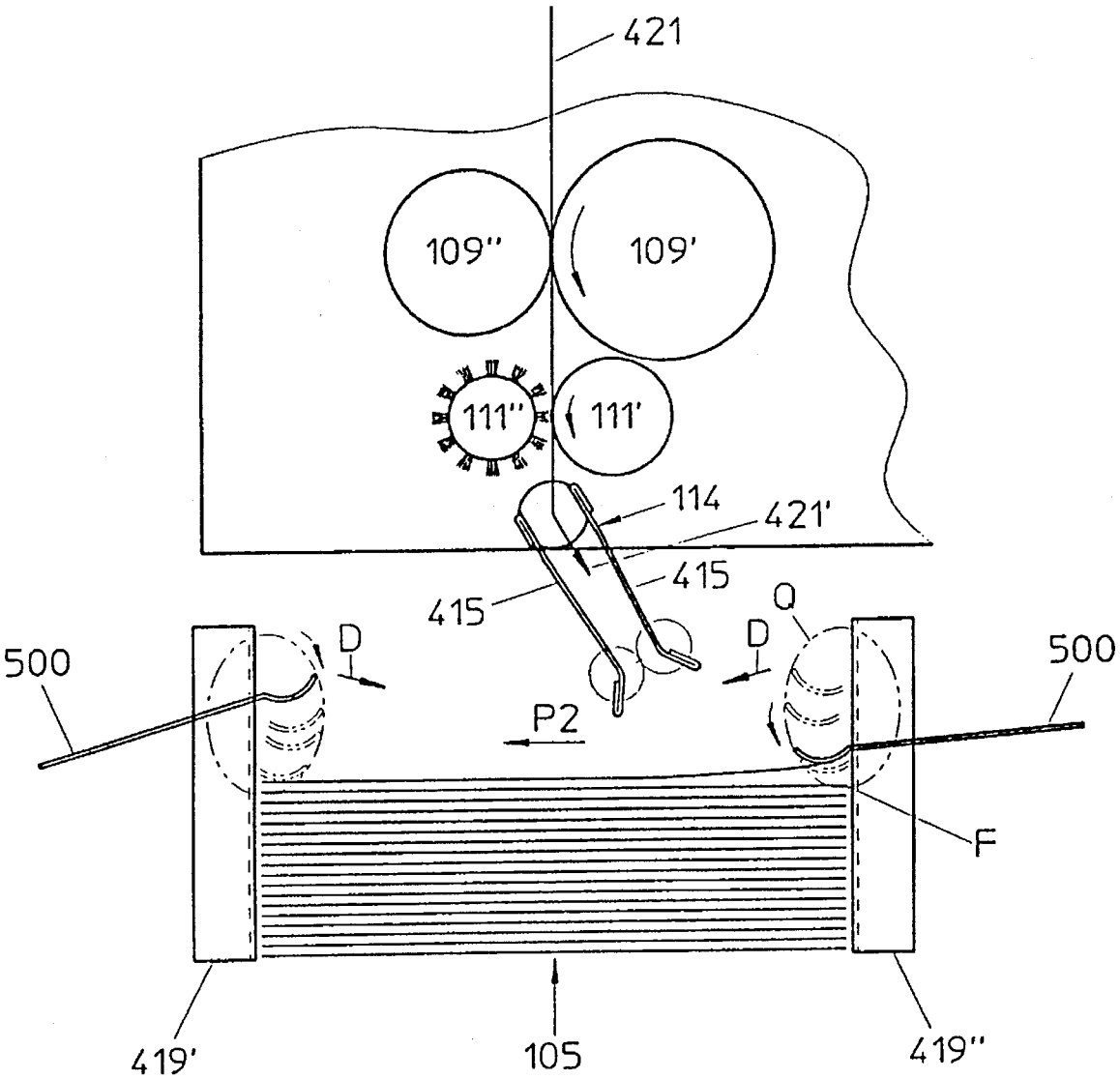

The operating principle of the folding rocker 114 and of the compressed-air system interacting with it is as follows:

FIG. 4*a* shows the zigzag-shaped folding and depositing of a web part 420 shortly after the beginning of stack formation. The folding rocker 114 is located in the left-hand end position and is about to move in the direction of the arrow P1 towards the other end position. The left-hand paddle 500, moving downwards along an elliptical path of movement Q engages the web part 420 in the region of a fold line, e.g., line of weakness 202, and draws the part 420 outwards towards the left-hand stop 419'. An accurate, neat folding along the line of weakness 202 thereby takes place to form a fold F. By means of spring-biased securing elements 425, known per se in the art, it is ensured that the folded web sections in the region of the fold remain pressed down on the stack. FIG. 4*b* shows the folding and stacking operation for the web part 420 at a later point in time. The folding rocker 114 has moved from the right-hand end position in the direction of the arrow P2 to the lefthand end position and is about to swing again to the right. FIG. 4*c* shows the folding and stacking operation of the web part 420 shortly before the end. The trailing edge of this web part 420 is denoted by 420". The folding rocker 114 is represented during the movement to the right or in the anticlockwise sense corresponding to the arrow P1 and thereby directs the trailing edge of the web part 420 onto the stack 105, onto which this end is deposited under the action of the lefthand paddle 500. Following on from the web part 420, firstly the leading edge 421' of the following web part 421 and progressively further regions of the web part 421 pass into the folding rocker 114, while the latter swivels to the left or in the clockwise sense in the direction of the arrow P2 (see FIG. 4*d*). The web section 421 is deposited under the influence of blasting air (indicated by the arrow D in FIG. 4*d*) onto the stack 105, the leading edge 421 coming to bear against the left-hand stop 419'. The folding rocker 114 then swivels again in the anticlockwise sense and thereby deposits the remainder of the web section 421 onto the stack 105 in the way described. Apparatus for delivering air jets and means for controlling the intermittent delivery of jets of air are known in the art and will not be described further.

If web parts 420, 421 et seq. are individual sheets, each sheet is normally conveyed with the leading edge against the same stop, for example, the left-hand stop 419' and its trailing edge reaches the right-hand stop 419". Subsequently, without the flow of web onto the stack, the folding rocker 114 swivels once again in the clockwise sense and directs the leading edge of the next web section (individual sheet) towards the left-hand stop 419'. This achieves the effect that in the case of all the individual sheets or first sections of the web parts it is always the same surface of the original material web 102 which is directed downwards in the stack 105.

For depositing a longer web part 103' onto the stack 105, the folding rocker 114 swings back and forth between its end positions until the trailing edge of the web part 420 or 103' is deposited at one of the stops 419' or 419". If the length of the web part corresponds to an odd number of individual sheets, this trailing edge is located at the right-hand stop 419", and the folding rocker 114 continues its swinging movement, as described above with reference to the depositing of individual sheets, and brings the leading edge of the then following web part 103' as with an individual sheet in turn to the left-hand stop 419'. If the length of the web part corresponds to an even number of individual sheets, the said trailing edge of the web part is located at the left-hand stop 419'. If it is wished to achieve the effect that in the case of the following individual sheet or the first section of the following web part it is again the same side of the material web which comes to lie downwards, the sequence of movements must be changed, i.e., feeding of the next web part must begin also at left-hand stop 419'. It will be appreciated that in some instances the folding rocker 114 must execute an idle stroke, in order that the depositing operation can be begun again, as described, at the left-hand stop 419'. Control means to adapt the system to web parts of an odd or even number of sheets are known per se and will not be described further. This change in the sequence of movements of the folding rocker 114 is not required if it is not necessary for all the leading edges in the stack to be arranged congruently or if there is no necessity for the same side of the original material web always to be directed downwards or upwards in the stack.

In order that individual sheets or longer web parts 103' are deposited correctly onto the stack 105 and web parts 103' are folded satisfactorily at the desired location, there is provided, as mentioned further above, a folding and holding-down device which, in the case of the present illustrative embodiment according to FIGS. 1, 4*a*, 4*b*, 4*c* and 4*d*, has two folding and holding-down elements (paddles) 500, which are arranged in the region of the stops 419' and 419" and which are controlled by means of a drive device in such a way that they execute opposing movements along closed, elliptical paths.

Figure 5A:
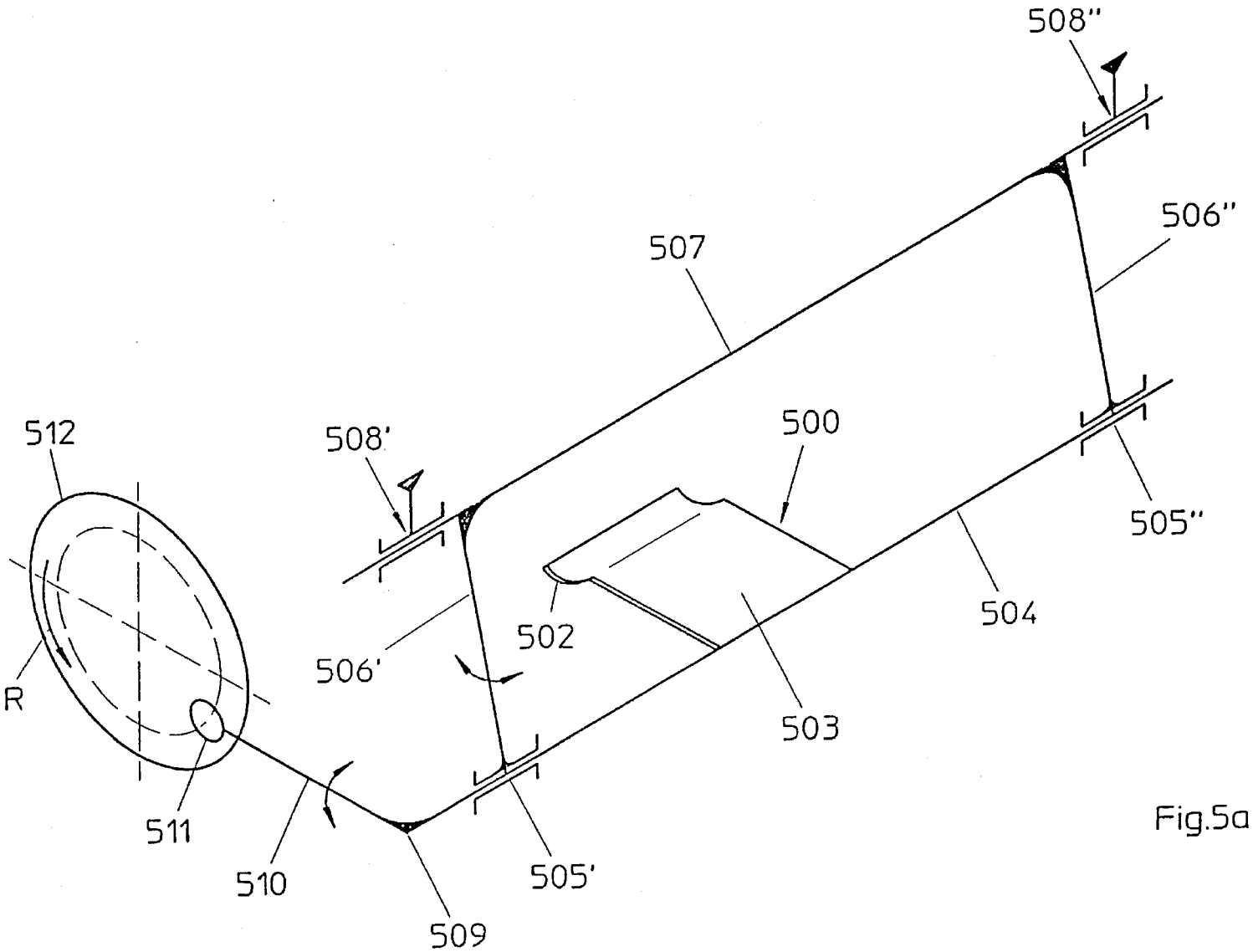
FIGS. 5*a* and 5*b* show, simplified, in a perspective representation and in elevation, respectively, details of the structure, drive and operation of a preferred folding and holding-down device according to this invention for depositing and folding individual sheets or web parts.

FIG. 5*a* shows the support mechanism or paddle suspension system and drive device or arrangement 501 for the righthand paddle 500. It is located near the side of stack 105, and extends horizontally (FIG. 5*a*) between stops 418", 419", above and laterally outward from the side (FIG. 1). The paddle 500 has, as already mentioned, an active face 502, with which the paddle 500 comes into contact with the web part to be deposited and which is advantageously designed convexly in the direction of the stack 105. The paddle 500 is firmly connected by means of a support part 503, which extends laterally beyond the side of stack 105 (FIG. 1) to a suspended paddle shaft 504. The suspension system will now be described. The paddle shaft 504 is pivotally connected by means of two bearings 505' and 505" to two arms or bars 506' , 506" which are rigidly connected to a pivot spindle 507, which is parallel to the paddle shaft 504 and which for its part is mounted rotatably in fixed bearings 508' and 508". The paddle shaft 504 is firmly, or rigidly, connected at 509 to the one end of a guide rod or crank arm 510. The other end of the guide rod 510 is connected eccentrically and articulately at 511 to a rotating driving disc 512. The guide rod 510 and the driving disc 512 lie essentially in a plane which runs perpendicularly with respect to the paddle shaft 504 and with respect to the swivel spindle 507. For the left-hand paddle, a device constructed identically but oppositely is provided.

Figure 5B:
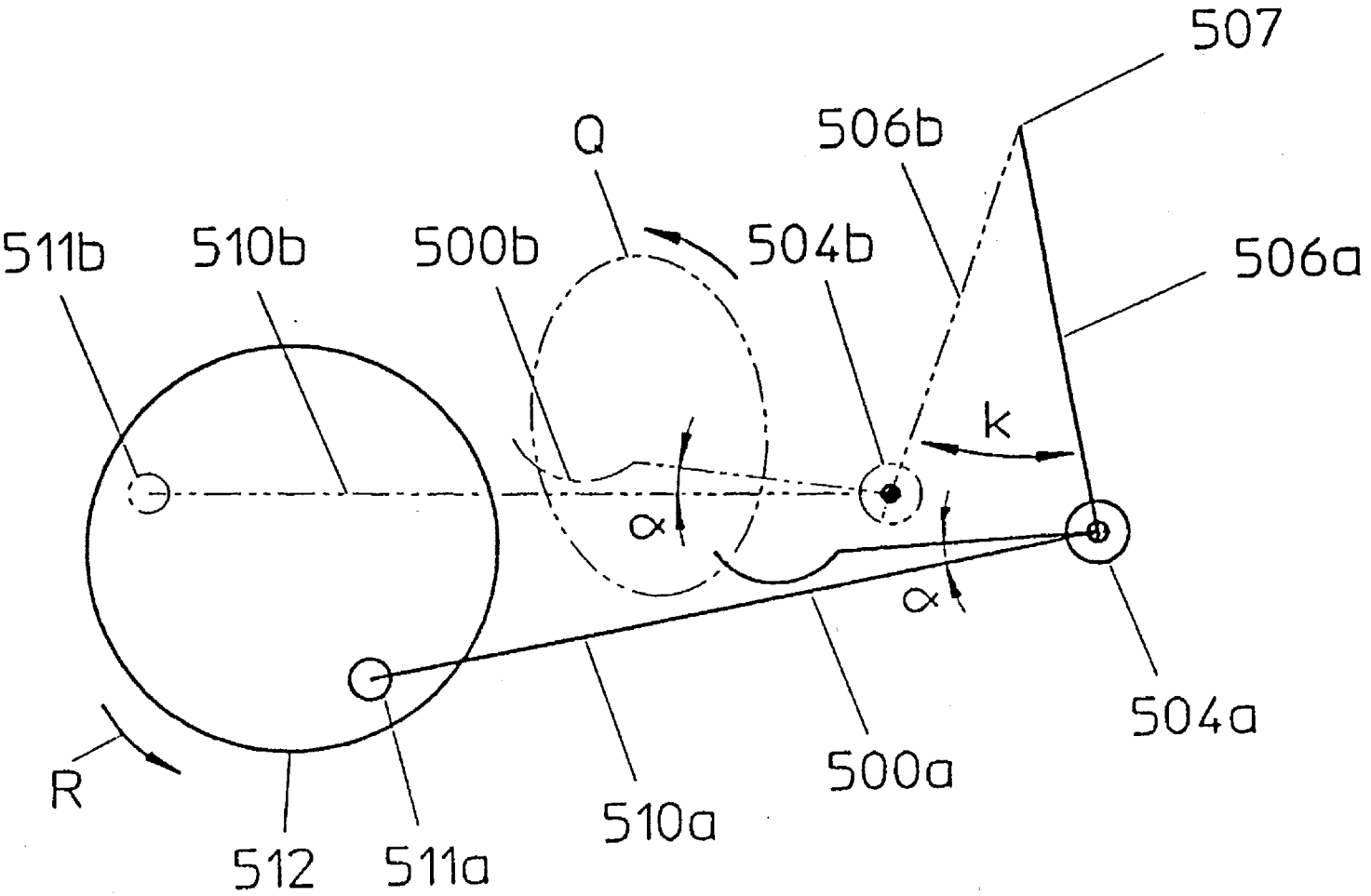

FIG. 5*b* shows the basic operating principle of the drive arrangement 501 described above for the right-hand paddle 500, to be precise in a first position by solid lines, an "a" having been added to the reference numerals of FIG. 5*a*, and in a second position by broken lines, a "b" having been added to the reference numerals. When there is a rotation of the driving disc 512, a rotatingly driven drive wheel, in the direction of the arrow R, the guide rod or crank arm moves from the position 510*a* towards the position 510*b*. At the same time, the paddle shaft 504 moves out of the position 504*a* into the position 504*b* and the bars move out of the position 506*a* into the position 506*b*. Since the paddle 500 is firmly connected to the paddle shaft 507, it forms with the guide rod 510 in every position the fixed angle α. This arrangement achieves the effect that, while the paddle shaft 504 is swinging pivotally about the swing spindle 507, the paddle 500 remains essentially parallel to the top of stack 105 with active face 502 always directed at the stack, since the paddle shaft 504 swings about the swing spindle 507 along an arc of a circle indicated by k, although the paddle 500, as mentioned, always forms the same angle α with the guide rod both in the position 500*a* and in the position 500*b* and also in all intermediate positions. Depending on the choice of dimensions of the various components, various path curves Q can be achieved for the paddle 500. It is particularly advantageous to design the drive arrangement in such a way that the active face 502 of the paddles 500 moves along an elliptical curve Q from above towards the stack and then laterally outwards towards the stops 419' , 419" as is represented in FIGS. 4*a*, 4*b*, 4*c* and 4*d*. The arrangement shown in FIGS. 5*a*, 5*b* causes pressing element 500 to remain essentially horizontal, that is, essentially parallel to itself, at least as it moves downwardly and outwardly to guide each web part and press it onto the stack (see also FIG. 1).

Thus, when folding web parts 103', the paddles 500 are moved from above towards the material web, engage the latter with their active face 502 and press the web loop forming (drawn by broken lines in FIG. 4*a*) downwards and laterally outwards towards the sides of stack 105, represented by stops 419' , 419" This results in a creaseless folding of the material web accurately along the lines of weakness 202 or along fold lines already formed beforehand.

Thanks to the movement described of the paddles 500, it is also possible to fold neatly along a line material webs which are neither prefolded nor provided with lines of weakness, i.e. material webs which come directly from a printer or are unrolled from a reel.

I claim:

1. Apparatus for pressing a plurality of incoming web parts fed in zig-zag fashion from above onto a stack supported by a horizontal support, said stack having a first vertical side and a second vertical side opposite said first side, comprising a) a support mechanism outside said stack proximate said first side, comprising (i) a first shaft having a first longitudinal axis parallel both to said first side and to said horizontal support, and (ii) a suspension system comprising a rotatable second shaft having a second longitudinal axis parallel to said first longitudinal axis and connected to said first shaft by connecting arms, said second shaft being rigidly attached to said connecting arms and said first shaft being rotatably attached to said connecting arms and pivotally connected to said second shaft by said arms, b) a drive means including a crank arm drivingly connected to said support mechanism to cause said first shaft to pivot relative to said second shaft in a first, vertical, closed path, and c) a pressing element, elongated in the direction of said first axis, rigidly attached to said first shaft and extending toward said stack, said pressing element having an orientation essentially parallel to said horizontal support, whereby travel of said first shaft along said first closed path causes said pressing element to travel a second, closed, essentially elliptical path while essentially maintaining said orientation.

2. Apparatus according to claim 1 wherein said first shaft is rotatably mounted by means of bearings and wherein said second shaft is rotatably mounted by means of bearings.

3. Apparatus according to claim 2 wherein said drive means includes a rotatingly driven drive wheel to which said crank arm is eccentrically and articulately fastened, and wherein said first shaft is rigidly connected to said crank arm.

4. Apparatus according to claim 3 further comprising a system for forming said plurality of web parts from a continuous material web, comprising an upstream pair of rollers and a downstream pair of rollers separated therefrom by a separating zone, said upstream pair of rollers consisting of a first driven transport roller having a first circumferential speed and a clamping roller for releasingly clamping said web thereto, said downstream pair of rollers consisting of a second driven transport roller having a second circumferential speed greater than said first circumferential speed and a tearing roller for releasing clamping said web thereto along a line proceeding diagonally across said web, whereby, clamping the clamping roller to the first transport roller and clamping the tearing roller to the second transport roller exerts on said web a tearing force progressing diagonally across said web.

5. Apparatus according to claim 1 further comprising a system for forming said plurality of web sections from a continuous material web, comprising an upstream pair of rollers and a downstream pair of rollers separated therefrom by a separating zone, said upstream pair of rollers consisting of a first driven transport roller having a first circumferential speed and a clamping roller for releasingly clamping said web thereto, said downstream pair of rollers consisting of a second driven transport roller having a second circumferential speed greater than said first circumferential speed and a tearing roller for releasing clamping said web thereto along a line proceeding diagonally across said web, whereby, clamping the clamping roller to the first transport roller and clamping the tearing roller to the second transport roller exerts on said web a tearing force progressing diagonally across said web.

6. Apparatus according to claim 5 wherein said clamping roller includes a radially projecting raised first section over only a portion of its circumference, said first section having a leading edge parallel to the axis of said roller and wherein said tearing roller includes a radially projecting raised second section over only a portion of its circumference, said second section having an helically progressing leading edge.

7. Apparatus according to claim 6 further comprising sensing means for controlling the turning of the clamping and tearing rollers.

8. Apparatus according to claim 7 further comprising a third pair of transport rollers downstream of said second pair of rollers.

9. Apparatus according to claim 5 further comprising a folding rocker intermediate said tearing roller and said stack.

10. Apparatus according to claim 1 further comprising a folding rocker for feeding said web parts in zig-zag fashion.

* * * * *